US006542122B1

(12) United States Patent
Bolin et al.

(10) Patent No.: US 6,542,122 B1
(45) Date of Patent: Apr. 1, 2003

(54) PATCH ANTENNA PRECISION CONNECTION

(75) Inventors: Thomas Bolin, Lund (SE); Peter Nordenström, Skanör (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/978,520

(22) Filed: Oct. 16, 2001

(51) Int. Cl.[7] ..... H01Q 1/26
(52) U.S. Cl. ..... 343/700 MS; 343/846
(58) Field of Search ..... 343/700 MS, 702, 343/829, 846; H01Q 1/24, 1/26, 1/38

(56) References Cited

U.S. PATENT DOCUMENTS

| | | | | |
|---|---|---|---|---|
| 5,030,961 A | * | 7/1991 | Tsao | 343/700 MS |
| 5,537,123 A | | 7/1996 | Mandai et al. | |
| 5,635,758 A | | 6/1997 | Drekmeier | |
| 5,649,306 A | | 7/1997 | Vannatta et al. | |
| 5,680,144 A | | 10/1997 | Sanad | |
| 5,694,135 A | | 12/1997 | Dikun et al. | |
| 5,918,189 A | | 6/1999 | Kivela | |
| 5,929,813 A | | 7/1999 | Eggleston | |
| 6,005,525 A | | 12/1999 | Kivela | |
| 6,006,117 A | | 12/1999 | Hageltorn et al. | |
| 6,025,802 A | | 2/2000 | Eggelston et al. | |
| 6,054,954 A | | 4/2000 | Eggelston et al. | |
| 6,116,694 A | | 12/2000 | Ying | |
| 6,201,501 B1 | | 3/2001 | Arkko et al. | |
| 6,339,402 B1 | * | 1/2002 | McKivergan | 343/702 |
| 6,339,404 B1 | * | 1/2002 | Johnson et al. | 343/794 |
| 6,414,641 B1 | * | 7/2002 | Carlson et al. | 343/702 |

FOREIGN PATENT DOCUMENTS

| | | |
|---|---|---|
| WO | WO 96/27219 A1 | 9/1996 |
| WO | WO 00/03453 A1 | 1/2000 |
| WO | WO 01/37369 A1 | 5/2001 |
| WO | WO 01/76006 A1 | 10/2001 |

* cited by examiner

*Primary Examiner*—Tho G. Phan
(74) *Attorney, Agent, or Firm*—Burns, Doane, Swecker & Mathis, L.L.P.

(57) ABSTRACT

An antenna has a radiator mounted on a substrate, at least two terminals that are connected to the radiator and that extend away from a surface of the substrate, and a circuit board that is electrically connected to the radiator via the terminals. The terminals are accommodated by respective contact areas, such as holes, in the circuit board and are advantageously resilient. In this way, mis-alignment between the substrate and the circuit board is compensated, reducing the risk of antenna frequency offset.

17 Claims, 3 Drawing Sheets

PATCH ANTENNA PRECISION CONNECTION

BACKGROUND

This invention relates generally to radio communication systems and, in particular, to antennas that can be built into portable terminals in such systems and that enable such terminals to communicate in several frequency bands.

The cellular telephone industry has made phenomenal strides in commercial operations in the United States as well as the rest of the world. Growth in major metropolitan areas has exceeded expectations and outstripped system capacities. Important aspects of the advance of radio communication systems like cellular telephone systems are a change from analog to digital transmission and selection of an effective digital transmission scheme. Current and planned digital radio telephone communication systems use frequency division multiple access (FDMA), time division multiple access (TDMA), code division multiple access (CDMA), and combinations of these.

To help ensure compatibility of equipment made by many manufacturers, many communication systems are defined by standards published by standards-setting organizations. For example, analog cellular telephone communication systems follow standards such as the Advanced Mobile Phone System (AMPS) and the Nordic Mobile Telephone (NMT) system, and digital systems follow standards such as TIA/EIA-136 that is published by the Telecommunications Industry Association and is now called simply TDMA, and the Global System for Mobile (GSM) that is now published by the Third Generation Partnership Project (3GPP).

One of the parameters specified by the various standards is the frequency band or bands used for control and information signals. For example, TDMA systems in the U.S. operate in frequency bands near 800 MHz and/or 1900 MHz, and GSM systems operate in frequency bands near 900 MHz and/or 1800 MHz.

A device like a handheld cellular telephone sends and receives radio signals in these frequency bands with an antenna that can take a number of different forms. (The antenna has a resonance frequency in the frequency band of interest.) For example, rod or whip antennas have been common, but have fallen from favor as cellular telephones have become smaller and have had to handle multiple frequency bands. Helical antennas have become more common since they are suited to high frequency applications where an antenna's length is to be minimized and since they can handle multiple frequency bands. For example, a small, non-uniform, helical, dual-band antenna is disclosed in commonly assigned U.S. Pat. No. 6,112,102 to Ying for "Multiple Band Non-Uniform Helical Antennas".

Even so, demand for handheld devices that are smaller and that can communicate in more than one frequency band has led to the design of new antennas that can be "built in" to the devices, which is to say that the outline of a device does not reveal the antenna in the way that a rod or whip antenna would be revealed. Devices having built-in antennas are described in U.S. Pat. No. 5,929,813 to Eggleston and its continuations.

Commonly assigned U.S. Pat. No. 6,166,694 to Ying for "Printed Twin Spiral Dual Band Antenna" and U.S. patent application Ser. No. 09/112,366 by Ying for "Miniature Printed Spiral Antenna for Mobile Terminals" describe small, built-in, multi-frequency-band antennas. As depicted in FIG. 3 of the '694 patent, which is incorporated in this application by reference, such an antenna may include two spiral conductor arms that have different lengths and that are mounted on a dielectric substrate that is itself mounted on a printed circuit board (PCB). Also as described in the '694 patent, electrical connections between the spiral arms and the circuit board are made by antenna feed and ground pins.

An electrically sensitive part of an antenna such as that described by Ying is its feed arrangement or connectors to the printed circuit board. FIGS. 1A, 1B depict one such arrangement in cross-section. A patch 101, which may include spiral arms and a dielectric substrate as described in the '694 patent, can be connected to a circuit board 103 by feed and ground terminals 105, 107 that depend from the patch 101 and are intended to make electrical contact with respective pads 109, 111 on the board 103. The patch 101 may be mounted on an exterior cover of the device such that assembly of the cover and the case of the device brings the terminals 105, 107 into physical contact with the pads 109, 111.

Besides simply needing to ensure that the terminals and pads are in contact when the device is assembled, it is usually important to maintain a predefined geometry of the feed and ground terminals in order to keep an accurate resonance frequency of the antenna. One way this has been done includes forming the terminals 105, 107 as J-shaped legs from the patch 101 itself, but the accuracy of the terminal geometry depends almost entirely on highly precise dimensions of the J-legs and minimal deflection of the J-legs from their nominal positions.

Excessive deflection and/or failure to connect can be caused by improper positioning of the patch 101 with respect to the board 103 in x, y, and z directions. As depicted in FIG. 1A, the patch and board are mutually displaced in the x-direction indicated by the arrow to such an extent that the terminals 105, 107 and pads 109, 111 fail to make contact. In FIG. 1B, the patch and board have been displaced in the z-direction indicated by the arrow to such an extent that the terminals have been deformed. Even if displacement in the other directions could establish contact between the terminals and pads, the geometry of the feed arrangement would be inaccurate, affecting communication performance of the antenna.

Although it is desirable from a cost perspective to attach such a patch to the cover of a device like a cellular phone, good assembly tolerances and hence proper connection geometry are difficult to ensure using typical manufacturing methods.

SUMMARY

This invention overcomes the problems described above at little or no extra cost with feed arrangements of antennas for mobile phone handsets, etc., that include combinations of connection pin design, sideways spring forces, and mating holes or cavities in the mating circuit boards.

In one aspect of the invention, an antenna has a patch radiating element having a feed terminal and a ground terminal that extend from the patch radiating element, and a circuit board that is electrically connected to the patch radiating element by the feed and ground terminals after the antenna is assembled. The circuit board has respective areas for electrically contacting the feed and ground terminals that accommodate displacement of the patch radiating element with respect to the circuit board as the antenna is assembled.

In further aspects, the respective contacting areas may be holes, and the feed and ground terminals may be formed as J-shaped legs from the patch radiating element and may exert respective spring forces against respective contacting areas when the antenna is assembled. The feed and ground terminals may extend into the respective contacting areas after the antenna is assembled, and the distance between the contacting areas may be about five millimeters, and each contacting area may be about two millimeters wide.

The contacting areas may be holes that are through-plated with a metal and that mechanically guide the feed and ground terminals to the circuit board as the antenna is assembled. The patch radiating element and the feed and ground terminals may be punched out of a sheet of a conductive material, with the sheet being about 0.15 millimeter thick and each of the feed and ground terminals being about ten millimeters long and bent substantially perpendicular from the patch radiating element before the antenna is assembled. The feed and ground terminals may be punched from the patch radiating element and have curved cross-sections, and the feed and ground terminals may be attached to the patch radiating element such that the feed and ground terminals engage the contacting areas, respectively, as the antenna is assembled.

In another aspect, an antenna has a radiator mounted on a substrate, at least two terminals that are connected to the radiator and that extend away from a surface of the substrate, and a circuit board that is electrically connected to the radiator via the terminals. The terminals are accommodated by respective holes in the circuit board and are resilient. In this way, mis-alignment between the substrate and the circuit board is compensated, reducing the risk of antenna frequency offset.

The terminals may be formed as J-shaped legs from the radiator, and may exert respective spring forces against sides of the respective holes when the antenna is assembled. The distance between the holes may be about five millimeters, and each hole may be about two millimeters wide.

The radiator and the terminals may be punched out of a sheet of a conductive material that is about 0.15 millimeter thick, and each of the at least two terminals may be about ten millimeters long and be bent substantially perpendicular from the radiator before the antenna is assembled. The terminals also may have curved cross-sections.

BRIEF DESCRIPTION OF THE DRAWINGS

The features, objects, and advantages of this invention will become apparent by reading this description in conjunction with the drawings, in which like items are identified by like reference characters and in which.

DETAILED DESCRIPTION

Figure 1A:
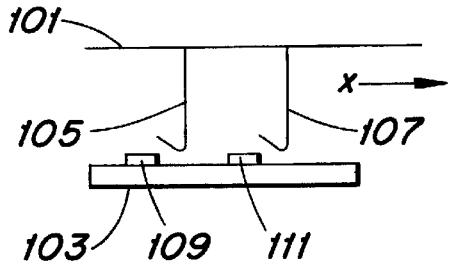
FIG. 1A PRIOR ART
FIGS. 1A, 1B are cross-sectional views of an antenna that show a feed arrangement from a circuit board.
Figure 1B:
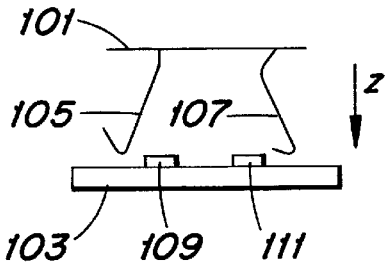
FIG. 1B PRIOR ART
Figure 2A:
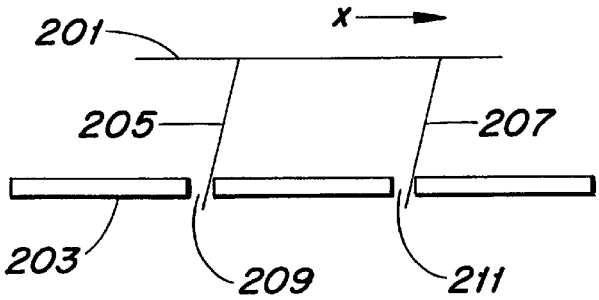
FIGS. 2A, 2B are cross-sectional views of another antenna that show a feed arrangement from a circuit board.
Figure 2B:
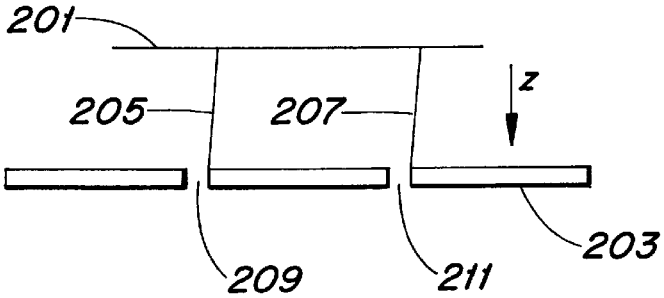

FIGS. 2A, 2B depict another antenna feed arrangement in cross-section that is in accordance with Applicants' invention. As in FIGS. 1A, 1B, a patch 201, or radiating element, such as that described in the '694 patent, can be connected to a circuit board 203 by feed and ground terminals 205, 207 that depend from the patch 201. To accommodate x, y, z displacements of the patch with respect to the board, the terminals 205, 207 make electrical contact with the board through respective holes 209, 211. As described above, the patch 201 may be mounted on an exterior cover of the device such that assembly of the cover and the case of the device brings the terminals 205, 207 into physical contact with the holes 209, 211.

Figure 3:
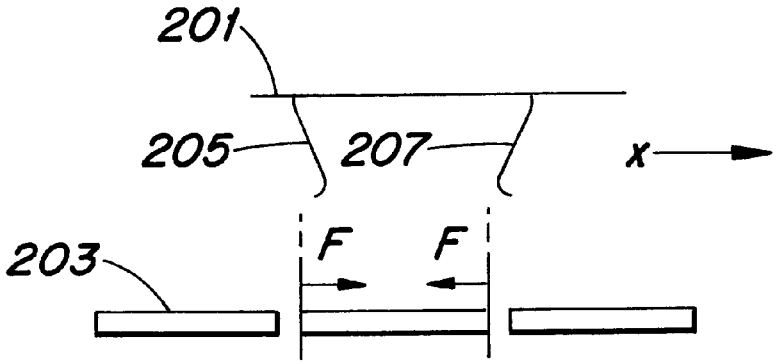
FIG. 3 is a cross-sectional view of an antenna that shows a feed arrangement including resilient terminals.

To obtain the advantages of the structure depicted in FIGS. 2A, 2B, the patch 201 is preferably made of a material such that the terminals 205, 207 can be formed by punching, bending, or the like. As depicted in FIG. 3, the terminals 205, 207 may be J-shaped legs that are advantageously resilient, i.e., they exert a spring force F in a direction such as the x-direction indicated by the arrow. It can be particularly advantageous for the terminals to exert their respective spring forces in opposite directions, e.g., in the +x- and −x-directions as shown. It will also be appreciated that the terminals may be resilient in the x- and y-directions simultaneously, as they would be if the terminals are made of metal.

Figure 4A:
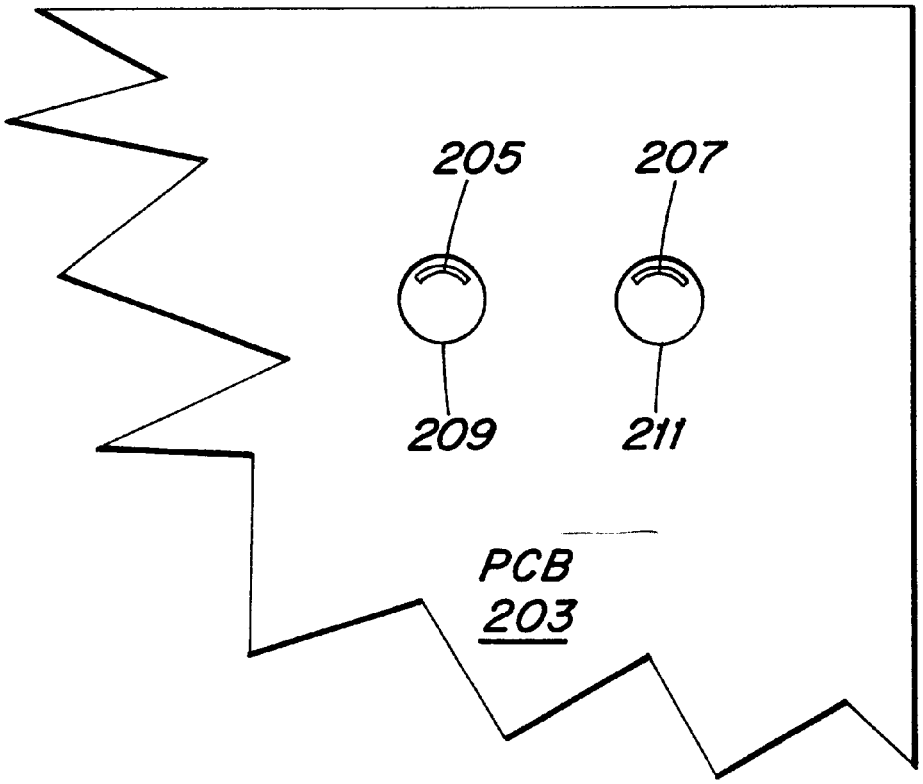
FIGS. 4A, 4B depict holes and terminals in a circuit board.
Figure 4B:
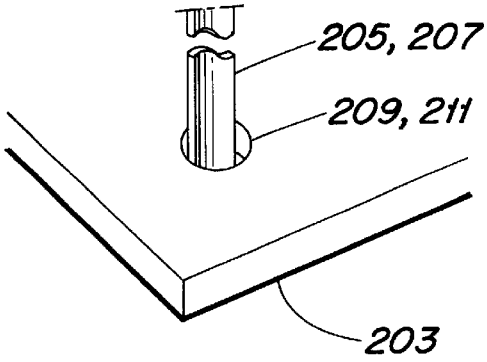

As depicted in FIGS. 4A, 4B, which depict a portion of the PCB 203, the terminals 205, 207 (shown in cross-section) extend into and perhaps through respective holes or half-cylinder cavities 209, 211 in the board 203 when the antenna is assembled. For an antenna suitable for cellular telephone use, the distance between the holes or cavities 209, 211 shown in FIG. 4A is typically about 5 millimeters (mm), and each hole is typically 1–2 mm wide. The holes 209, 211 are through-plated with a metal, e.g., gold, in a conventional way so that when the terminals are disposed in the holes, the terminals make electrical contact with the board and the circuitry on the board. Besides electrically connecting the terminals to the board, the holes or cavities 209, 211 mechanically guide the terminals to the board. This mechanical guidance permits more misalignment between the patch and board in the x-, y-, and z-directions with less risk of resonance frequency offset or even disconnection than conventional constructions.

The patch 201 and terminals 205, 207 are advantageously punched out of a sheet of a conductive material such as phosphor bronze, beryllium copper, stainless steel, silver alloy, etc., all of which are advantageously resilient. A sheet of such material is typically thin, about 0.15 mm thick, and large enough (e.g., about 40 mm×25 mm) for convenient handling and for the desired electromagnetic properties.

Figure 5A:
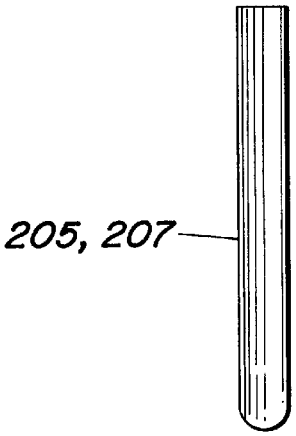
FIGS. 5A, 5B depict a terminal.
Figure 5B:
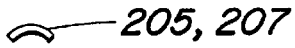

As depicted in FIGS. 5A, 5B, which show side and bottom (or cross-section) views, the terminals 205, 207 advantageously are each 1–2 mm wide and typically spaced apart about 5 mm for an antenna suitable for cellular telephone use. Each terminal may be 7–10 mm long and is typically bent about 90 degrees (perpendicular) from the patch. Although it is not necessary, the terminals can advantageously be given some additional rigidity and resilience by allowing them to develop a curved cross-section (see FIG. 5B) through the punching process.

It will be appreciated that the patch 201 can be connected to the PCB 203 in ways other than the punched-out legs and holes described above. For example, conductive strips can be attached to the spirals or other radiating elements of the patch and disposed in a manner such that they engage the holes 209, 211. For another alternative, pins (e.g., Pogo pins, which are spring-loaded devices that are commercially available from a number of sources, including Gold Technologies, Inc., San Jose, Calif.; and Emulation Technology Inc., Santa Clara, Calif.) can be attached to either or both of the patch 201 and PCB 203 such that the pins make the necessary electrical contacts when the antenna is assembled. If such pins are attached to the patch 201, electrical contact with the PCB 203 may not require holes or cavities 209, 211; it may be sufficient for the pins to contact flat, conductive regions of the board 203. For yet another alternative, female-type connectors can be mounted on the PCB and terminals 205, 207 can be inserted into these connectors. It is currently believed that these alternatives are more expensive to implement than the arrangement described above.

It will be appreciated that the parallelepiped or loop formed by the patch, terminals, and board has an area that remains substantially constant for varying misalignments along a line between the terminals (the x-direction in the FIGS.). This parallelepiped area or loop area can be part of the antenna matching arrangement, and thus keeping the area constant enhances the antenna's resistance to frequency offset.

As should be evident, an antenna built in accordance with this application can be mounted at the edge of a printed circuit board, which provides for better radiation efficiency and bandwidth. In addition, the board space needed for the antenna is minimized due to its small size.

This invention should not be construed as limited to the embodiments described above. For example, although an antenna having two terminals is described above, one skilled in the art will appreciate that an antenna can have more than two terminals. This description should be regarded as illustrative rather than restrictive, and it is expected that variations will be made by workers skilled in the art that will fall within the scopes of the following claims.

What is claimed is:

1. An antenna, comprising:

a patch radiating element having a resilient feed terminal and a resilient ground terminal that extend from the patch radiating element; and a circuit board that is electrically connected to the patch radiating element by the feed and ground terminals after the antenna is assembled, the circuit board having respective areas comprising holes for electrically contacting the feed and ground terminals that accommodate displacement of the patch radiating element with respect to the circuit board as the antenna is assembled, whereby misalignment between the patch radiating element and the circuit board is compensated by the holes.

2. The antenna of claim 1, wherein the feed and ground terminals are formed as J-shaped legs from the patch radiating element.

3. The antenna of claim 1, wherein the feed and ground terminals exert respective spring forces against respective contacting areas when the antenna is assembled.

4. The antenna of claim 3, wherein the feed and ground terminals extend into the respective contacting areas after the antenna is assembled.

5. The antenna of claim 1, wherein a distance between the contacting areas is about five millimeters, and each contacting area is about two millimeters wide.

6. The antenna of claim 1, wherein the contacting areas are holes that are through-plated with a metal and that mechanically guide the feed and ground terminals to the circuit board as the antenna is assembled.

7. The antenna of claim 1, wherein the patch radiating element and the feed and ground terminals are punched out of a sheet of a conductive material.

8. The antenna of claim 7, wherein the sheet is about 0.15 millimeter thick.

9. The antenna of claim 8, wherein each of the feed and ground terminals is about ten millimeters long and is bent substantially perpendicular from the patch radiating element before the antenna is assembled.

10. The antenna of claim 1, wherein the feed and ground terminals are punched from the patch radiating element and have curved cross-sections.

11. The antenna of claim 1, wherein the feed and ground terminals are attached to the patch radiating element such that the feed and ground terminals engage the contacting areas, respectively, as the antenna is assembled.

12. An antenna, comprising:

at least one radiating element mounted on a substrate;

at least two terminals that are connected to the at least one radiating element and that extend away from a surface of the substrate; and a circuit board that is electrically connected to the at least one radiating element via the at least two terminals after the antenna is assembled;

wherein the at least two terminals are resilient and are accommodated by respective holes in the circuit board, whereby misalignment between the substrate and the circuit board is compensated.

13. The antenna of claim 12, wherein the at least two terminals are formed as J-shaped legs from the at least one radiating element.

14. The antenna of claim 12, wherein the terminals exert respective spring forces against sides of the respective holes when the antenna is assembled.

15. The antenna of claim 12, wherein a distance between the holes is about five milimeters, and each hole is about two millimeters wide.

16. The antenna of claim 12, wherein the at least one radiating element and the at least two terminals are punched out of a sheet of a conductive material that is about 0.15 millimeter thick, and each of the at least two terminals is about ten millimeters long and is bent substantially perpendicular from the at least one radiating element before the antenna is assembled.

17. The antenna of claim 16, wherein the at least two terminals have curved cross-sections.

* * * * *